US007168585B2

(12) United States Patent
Baughman

(10) Patent No.: US 7,168,585 B2
(45) Date of Patent: Jan. 30, 2007

(54) CONTAINER AND METHOD FOR PREVENTING LEAKAGE THEREFROM THROUGH ISOLATING DEFORMATION IN THE CONTAINER

(75) Inventor: Gary M. Baughman, Auburn, IN (US)

(73) Assignee: Rieke Corporation, Auburn, IN (US)

( * ) Notice: Subject to any disclaimer, the term of this patent is extended or adjusted under 35 U.S.C. 154(b) by 283 days.

(21) Appl. No.: 10/818,191

(22) Filed: Apr. 5, 2004

(65) Prior Publication Data

US 2004/0245252 A1 Dec. 9, 2004

Related U.S. Application Data

(63) Continuation of application No. 10/224,287, filed on Aug. 19, 2002, now Pat. No. 6,722,519, which is a continuation-in-part of application No. 10/071,602, filed on Feb. 8, 2002, now Pat. No. 6,793,088.

(51) Int. Cl.
*B65D 51/18* (2006.01)
*B65D 53/00* (2006.01)

(52) U.S. Cl. ..... 220/254.8; 220/304; 220/601

(58) Field of Classification Search ..... 285/203, 285/204; 215/317; 220/254.1, 254.8, 259.4, 220/288, 301.1, 304, 310.1, 345.6, 378, 601, 220/661

See application file for complete search history.

(56) References Cited

U.S. PATENT DOCUMENTS

| | | | | |
|---|---|---|---|---|
| 3,098,579 | A * | 7/1963 | Wheaton | 220/304 |
| 3,208,775 | A * | 9/1965 | Stap et al. | 285/204 |
| 3,946,984 | A * | 3/1976 | Sutter | 251/129.03 |
| 3,987,929 | A * | 10/1976 | Mineo | 220/257.1 |
| 4,117,949 | A * | 10/1978 | Dwinell | 220/304 |
| 4,706,836 | A * | 11/1987 | Greck | 220/259.4 |
| 5,052,576 | A * | 10/1991 | Budenbender | 220/304 |
| 5,853,100 | A * | 12/1998 | Kars | 220/254.8 |
| 6,722,519 | B2 * | 4/2004 | Baughman | 220/254.8 |
| 6,793,088 | B2 * | 9/2004 | Baughman | 220/254.8 |
| 6,886,706 | B2 * | 5/2005 | Bakker | 220/200 |

* cited by examiner

*Primary Examiner*—Nathan J. Newhouse
*Assistant Examiner*—Harry Grosso
(74) *Attorney, Agent, or Firm*—Woodard, Emhardt, Moriarty, McNett & Henry LLP

(57) ABSTRACT

A container and method for preventing leakage therefrom through isolating deformation in the container caused by external forces. The container comprises a container wall having an opening therein, the opening capable of receiving a closure bushing with a sealing member wedged between the closure bushing and the container wall, and a weakened portion of the container wall not in wedged engagement with the sealing member capable of bending in response to an external force so as not to deform the portion of the container wall in wedged engagement with the sealing member.

7 Claims, 4 Drawing Sheets

CONTAINER AND METHOD FOR PREVENTING LEAKAGE THEREFROM THROUGH ISOLATING DEFORMATION IN THE CONTAINER

CROSS-REFERENCE TO RELATED APPLICATIONS

This is a continuation of U.S. patent application Ser. No. 10/224,287, filed Aug. 19, 2002, now U.S. Pat. No. 6,722,519, which is a continuation-in-part of U.S. patent application Ser. No. 10/071,602, filed Feb. 8, 2002, now U.S. Pat. No. 6,793,088.

FIELD OF INVENTION

The present invention relates generally to containers and, more particularly, to a container and method for preventing leakage therefrom through isolating deformation in the container.

BACKGROUND OF THE INVENTION

It is known in the art to provide containers for storing and transporting all types of materials. Such containers are typically in the shape of drums, but any number of configurations could be used so long as a reliable and resealable opening to the interior of the container is provided for filling and emptying the contents therein. Containers that hold liquids are particularly troublesome in that openings must be reliably mounted and sealed to the container to prevent leakage therebetween during transport and especially after being subjected to some type of external force applied to the container opening.

Conventional containers of this type typically include a sheet metal wall having a bunghole or opening for emptying or filling the container. The opening is usually defined by a closure bushing having an internally-threaded neck that can received an externally-threaded plug for sealing the opening and thus the contents of the container. The container wall typically includes an upwardly extending collar which surrounds the closure bushing.

When the closure bushing is fitted within the container wall collar, the closure bushing base flange is firmly pressed against the interior of the container wall collar with a sealing member compressed or wedged therebetween to provide the required seal. A second closure bushing flange is then flanged over the collar of the container opening so that the sealing ring can be held firmly wedged with pre-tension in this position. Therefore, when the closure bushing is secured within the container wall collar, the sealing member is wedged between the two parts and deformed, and because the sealing member material, such as rubber, retains its resiliency, the sealing member will insure a permanent seal.

The required closure seal is maintained so long as the sealing member is held firmly wedged between the closure bushing and container wall collar. However, as soon as the wedging reduces, the risk of leakage occurs between the container wall collar and the closure bushing. Such a reduction of the wedging can occur if the drum falls from a certain height onto a hard surface with the closure down. The closure bushing and upwardly extending container wall collar, which project upwardly relative to the rest of the container wall, may be pressed inwardly or bent in this case and could result in the closure bushing and the container wall collar being forced apart. Further, because containers are typically made of sheet metal, any bending or deformation of the container wall or upstanding container wall collar could result in the closure bushing and the container wall or container wall collar being forced apart permanently, thereby permitting leakage of liquid therebetween.

As a result, if the container wall or container wall collar is deformed to the extent that proper wedging is reduced, the seal cannot be maintained and leakage will likely occur. Currently, the prior art has attempted to solve this problem by reinforcing the seal between the closure bushing and the container wall collar. One such reference is U.S. Pat. No. 5,853,100 issued to Kars that discloses a drum with drum closure method that attempts to prevent leaking due to the deformation or compromise of the first seal by providing a second seal between the collar and the closure bushing or insert. As a result of the position of the additional seal between the collar and the insert, the '100 patent attempts to ensure that a proper seal is maintained even if the insert is pressed inwards relative to the collar as the result of a fall.

However, because the nature and extent of damage caused by external forces is unpredictable, utilizing a second seal will not likely prevent leakage in all cases, particularly when the external force impacts the closure bushing and container wall collar at an angle. In such a case, the container wall or container wall collar may be deformed to such an extent that both seals are compromised. Therefore, there is a need in the art to provide a container and container closure assembly that will maintain its seal wedge during the application of an external force that could cause container wall or container wall collar deformation.

BRIEF SUMMARY OF THE INVENTION

This object is achieved through permitting the container wall or portion of the container wall collar to deform in a predetermined portion thereof in response to an external force in order to maintain proper sealing wedge.

It is a further object of this invention to provide a method for preventing leakage from a container closure assembly by providing a weakened portion in the container wall or portion of the container wall collar to deform in a predetermined manner in response to an external force in order to maintain proper sealing wedge.

The forgoing and other objects of this invention are achieved by providing a container comprising a container wall having an opening therein, the opening capable of receiving a closure bushing with a sealing member wedged between the closure bushing and the container wall, and a means for permitting a portion of the container wall not in wedged engagement with the sealing member to bend in response to an external force so as not to deform the portion of the container wall in wedged engagement with the sealing member. The means for permitting the container wall to bend in response to an external force may be accomplished by providing the container wall with a weakened portion that is more susceptible to deformation caused by external forces and therefore can absorb deformation which may have effected the sealing wedge. The weakened portion may be annular in shape so as to absorb external forces applied to the container wall or container wall collar from any angle. Such weakened portion could comprise a portion of prior stressed or bent container wall as well as a notch formed in the container wall.

The present invention will be more fully described in the following written description with reference to the accompanying drawings.

DETAILED DESCRIPTION OF THE INVENTION

The invention is described herein with regard to drum containers used for storing and transporting liquids. The preferred embodiment as described herein is directed to steel drums, commonly 55-gallons in size. However, the description of the embodiments herein should in no way limit the scope of the claims presented. It would be obvious to one skilled in the art that this invention could be used for any container, whatever the configuration and composition, to transport materials of any composition and still fall within the scope of the appended claims.

Figure 1:
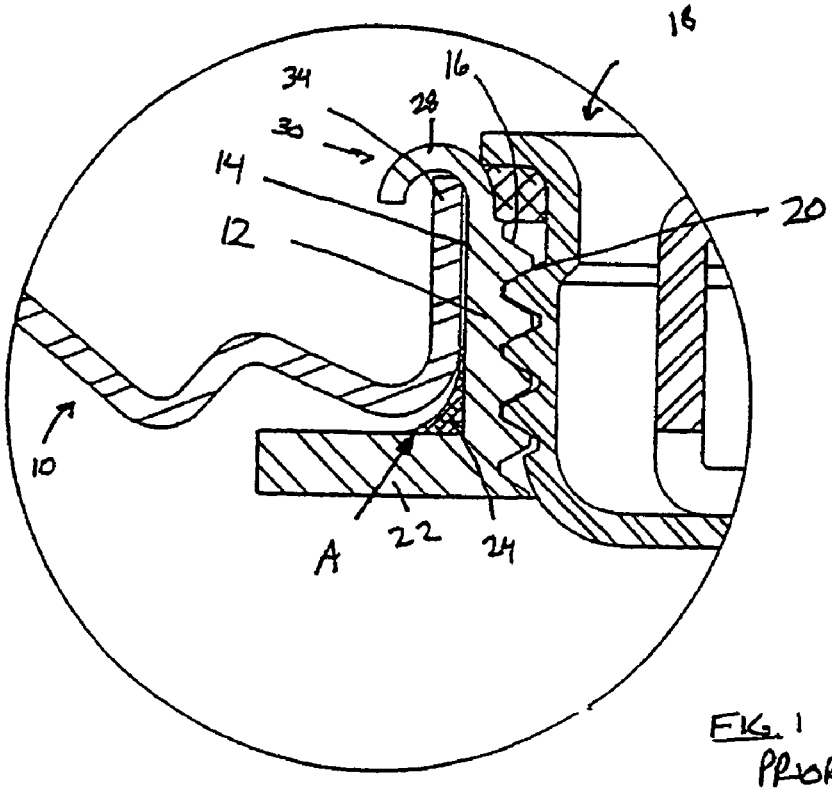
FIG. 1 PRIOR ART
FIG. 1 is a fragmentary, cross-sectional view of a prior art closure showing a sealing wedge failure due to the deformation effects of an external force.
Figure 2:
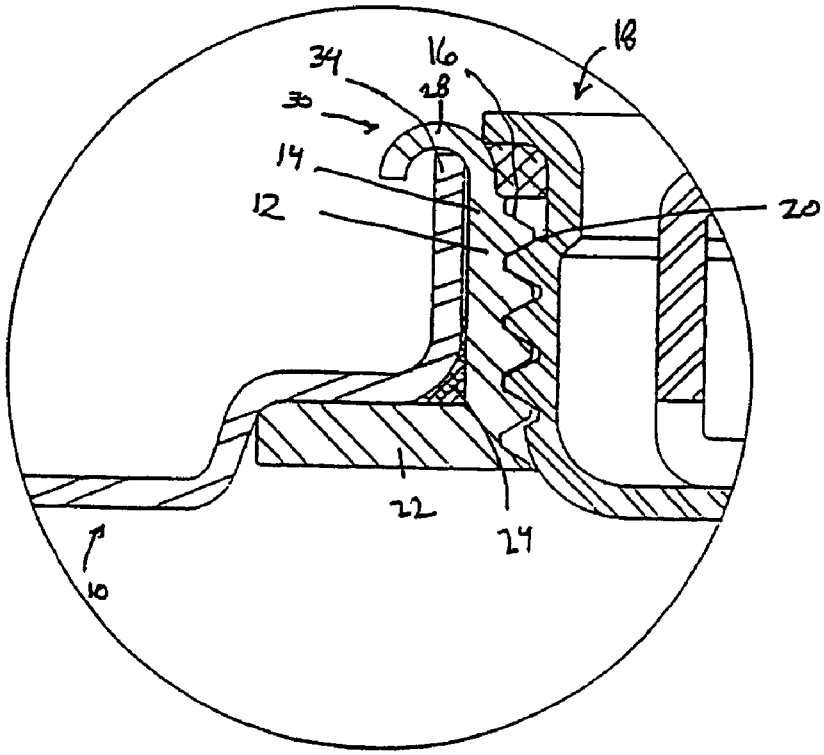
FIG. 2 PRIOR ART
FIG. 2 is a fragmentary, cross-sectional view of the prior art closure of FIG. 1 prior to application of an external force.

Reference is now made to the drawings. FIGS. 1 and 2 show a fragmented, cross-sectional view of a typical 55-gallon container, herein a drum, commonly used in the art for the shipping and storage of industrial liquid products. In the particular container closure assembly illustrated, the drum head or container wall 10 is provided with at least one threaded closure bushing 12 to facilitate filling and dispensing of the container contents. Normally, two closures are used having varied dimensions such as 50 mm and 20 mm sized diameters. Because both closures can utilize the same construction, for the sake of simplicity, only one closure is shown herein.

Turning to the construction of the container closure assembly in FIGS. 1 and 2 in greater detail, a closure bushing 12 is provided with an upstanding neck 14 having an outer cylindrical surface and an internal screw thread 16 for threaded reception of a closure plug 18 having an external screw thread 20. The lowermost end of the neck 14 is surrounded by a laterally-extending, polygonal-shaped base 22 having a bottom surface and a top surface joined to the neck outer surface. As is common in the art, the base outer edge is formed in the shape of an octagon having eight flats and eight points. The base 22 of the closure bushing 12 extends laterally into a container wall embossment or recess to tightly confine the base 22. The recess is of the same configuration as the base 22 so at to ensure that the closure bushing 12 will not rotate during insertion or removal of the plug 18. While containers in the art typically utilize an octagonal-shaped recess and base, it should be noted the invention described below could be equally well employed in any container utilizing another configuration or torque-resisting construction. A resilient sealing member 24 surrounds the lower end of the closure busing neck 14 and is placed within the closure bushing pocket defined by the base 22 and closure bushing neck 14. The sealing member 24 is of common annular construction and made of typical resilient material such as rubber.

As is known in the art, the closure bushing 12 is inserted into an upwardly-extending container wall collar 34 terminating in an opening. A vertical flange 28 projects upwardly, as clearly seen in the drawings, where it is curled radially outwardly over the container wall collar 34. The bead 30 encases the upper portion of the container wall collar 34 to provide the required pressure or wedge between the container wall 10 and the closure bushing 12, in the course of which sealing member 24 is compressed therebetween. The resultant effect is that sealing member 24 is held under pre-tension to form an appropriate seal between closure bushing 12 and container wall collar 34. Additional sealing members can be placed on other portions of the closure bushing as known in the art to further ensure the proper seal.

However, when there are great deformations, for example, those which occur as the result of the container falling with the closure facing down, the closure bushing 12 of the prior art construction can be depressed within the container and result in a deformation of the container wall 10 shown at FIG. 1. If the closure bushing 12 is pressed greatly inwards, the resultant deformation of the container wall 10 may result in the base 22 depressed a great distance from the container wall 10. All or a great part of the pretension in sealing member 24 is consequently lost, as shown by arrow A in FIG. 1, which could give rise to leakages.

Figure 3:
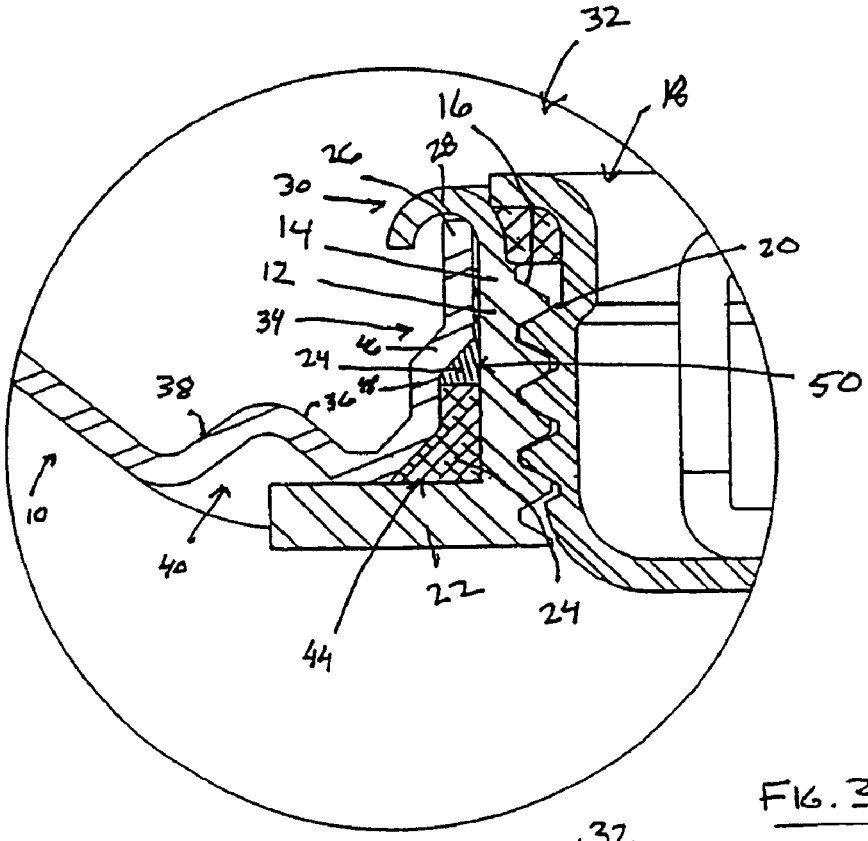
FIG. 3 is a fragmentary, cross-sectional view of a closure of the present invention showing the sealing wedge maintained after the application of an external force.
Figure 4:
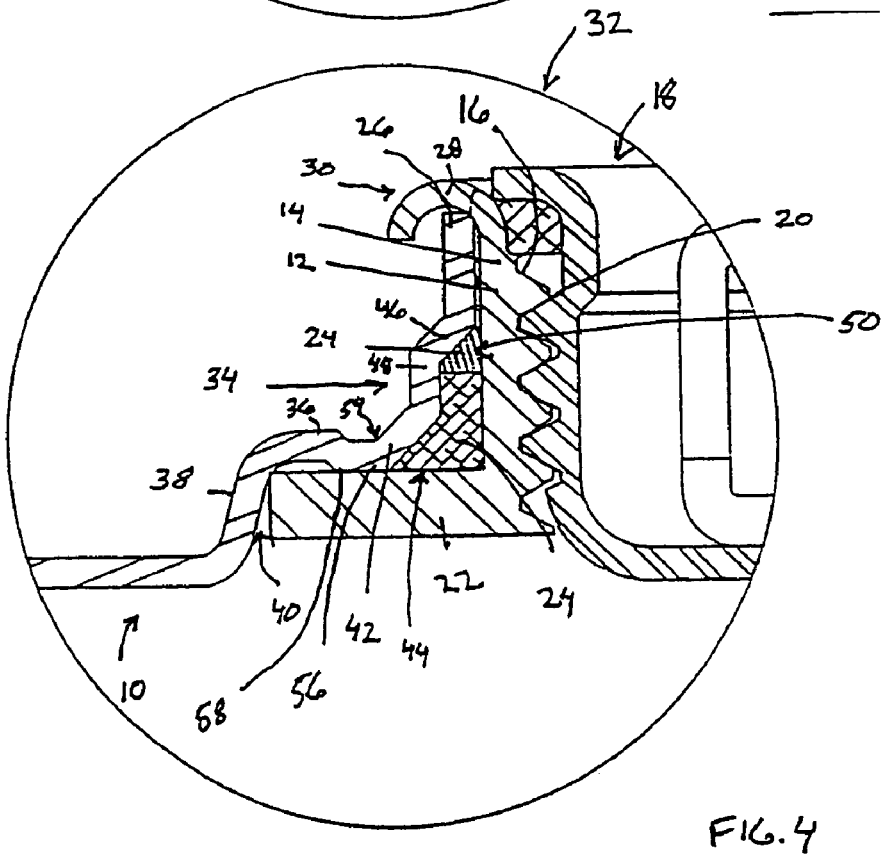
FIG. 4 is a fragmentary, cross-sectional view of the closure of FIG. 3 prior to the application of an external force.

With regard to the present invention, and directed particularly to FIGS. 3 and 4, much of the structure of the present invention is similar to that of the prior art. Therefore, like elements are labeled with like reference numerals to provide simplicity of description. However, this invention is directed to and includes means for permitting a portion of the container wall, not in wedged engagement with the sealing member, to bend in response to an external force so as not to deform the portion of the container wall in wedged engagement with the sealing member. Therefore, the invention disclosed herein, and covered by the appended claims, could utilize the structure of the prior art having such means for permitting a portion of its container wall to bend as required. Such a construction could include the prior art structure having an annular notch located on the recess wall of the upstanding collar and still fall within the scope of the appended claims. Such an invention is not shown or described in the prior art.

FIG. 4 shows the preferred embodiment of the present invention wherein a container closure assembly 32 comprises a closure bushing 12 provided with an upstanding neck 14 having an outer cylindrical surface and an internal screw thread 16 for threaded reception of a closure plug 18. The lowermost end of the neck 14 is surrounded by a laterally-extending, polygonal-shaped base 22 having a bottom surface and a top surface joined to the neck outer surface. At least one sealing member 24 surrounds the lower end of the closure busing neck 14.

The container wall 10 includes an upwardly-extending container wall collar 34 which is integral therewith. It should be noted, however, that this invention is not limited to containers having an upwardly-extending container wall collar only. As described herein, this invention could be utilized where the closure bushing is mounted directly to a flat container wall and still fall within the claims as presented herein. Further, it is acknowledged that the container wall collar 34 is typically integrally formed with the container wall 10. Therefore, the disclosure herein acknowledges that the upwardly-extending container wall collar 34 can be described in its broadest sense as a portion of the container wall 10. Thus, these terms my be used interchangeably within the following description.

Figure 5:
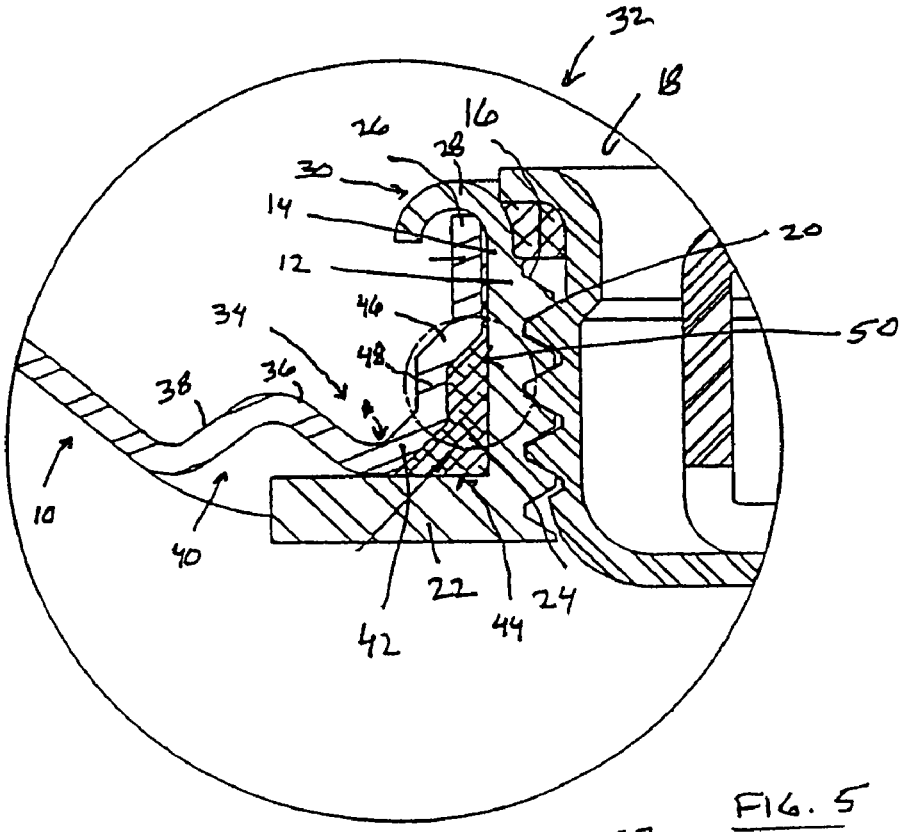
FIG. 5 is a fragmentary, cross-sectional view of a second embodiment of the present invention showing the sealing wedge maintained after the application of an external force.
Figure 6:
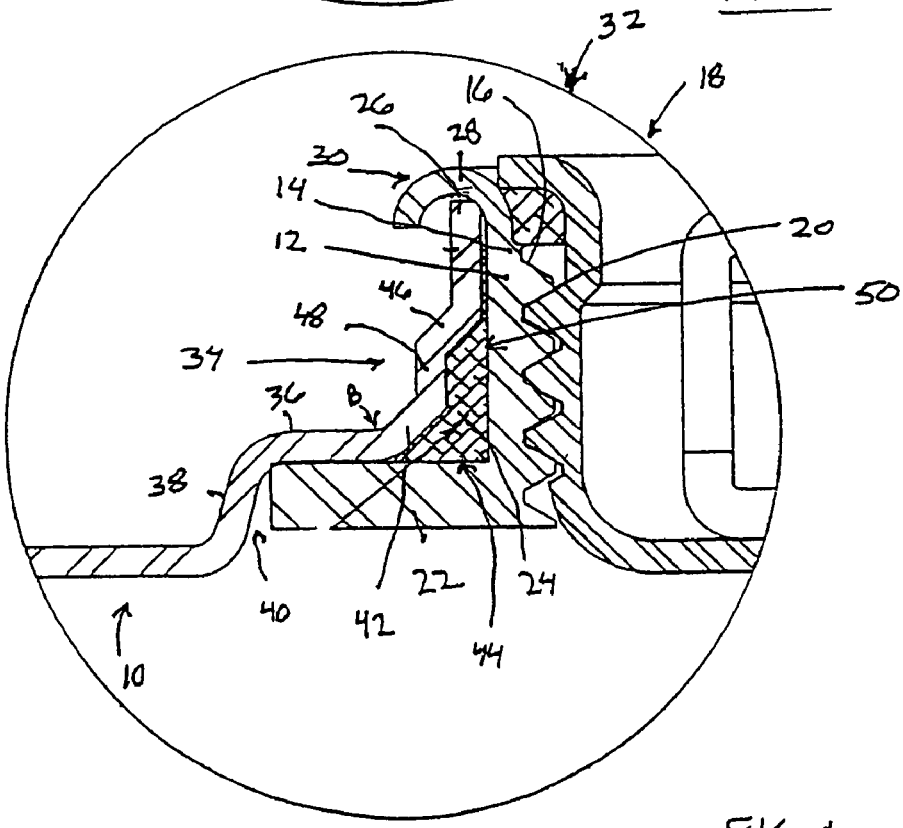
FIG. 6 is a fragmentary, cross-sectional view of the closure of FIG. 5 prior to the application of an external force.

With particular reference to FIGS. 4 through 6, the container wall 10 includes an upwardly-extending container wall collar 34 integral therewith and defining an opening within the container wall 10. The opening is capable of receiving a closure bushing 12 for providing access to the interior of the container for insertion and removal of materials. The container wall collar 34 comprises a recessed wall 36 connected to the container wall 10 by a first annular wall 38 to define a first recess area 40. It is within this first recessed area 40 that closure bushing base 22 is nested during wedging of the closure bushing. A second, inwardly sloped, annular wall 42 is connected to the recessed wall 38 to define a second recess area 44 capable of retaining and wedging at least one sealing member 24. A third, inwardly sloped, annular wall 46 is connected to the second, inwardly sloped, annular wall 42 by a first upwardly extending flange 48, wherein the third, inwardly slope, annular wall 46 and the flange 48 define a third recess area 50 capable of retaining and wedging at least one sealing member, which may be the same sealing member 24 retained in the second recess area 44. Finally, a second, upwardly extending flange 26 is connected to the third, inwardly sloped, annular wall 46 to form the container opening. The container wall or the container wall collar includes means for permitting a portion of the collar 34 or container wall 10 to bend in response to an external force so as not to deform the portion of the collar 34 in wedged engagement with the sealing member 24 as described in detail below.

The closure bushing 12 is fixed to the container wall collar 34 by wedged insertion. The closure bushing 12 is inserted through the container wall collar 34 through the interior of the container. The closure bushing 12, having at least one sealing member 24, is pressed towards the container wall collar 34, in the course of which sealing member 24 is compressed, and vertical flange 28 is flanged over flange 26. The resultant effect is that sealing member 24 is held under pre-tension to form an appropriate seal between closure bushing 12 and container wall collar 34. With the construction as described, the container closure assembly is formed with two recessed areas 44,50 retaining at least one sealing member 24 in wedged engagement and a means for permitting a portion of the collar 34 or container wall 10 to bend in response to an external force so as not to deform the portion of the collar 34 in wedged engagement with sealing member 24.

With regard to describing the means for permitting a portion of the collar 34 or container wall 10 to bend in response to an external force, the disclosure herein only describes those means in reference to the container wall collar 34. However, the means described herein could likewise be utilized directly on the container wall 10 and accomplish the purpose of the invention. Also, the means for permitting a portion of the container wall collar or container wall to bend in response to an external force is located on a portion thereof that is not in wedged engagement with said sealing member. This is because the container wall collar 34 or container wall 10 should deform at a predetermined point so as not to deform the portion of the container wall collar or container wall in wedged engagement with the sealing member.

As shown in FIGS. 4 through 8, means for permitting bending in the container wall collar 34 could comprise a weakened portion of the container wall collar 34 therein that is more susceptible to deformation caused by external forces. Such a weakened portion could be a portion made from a material different from the rest of the container wall collar to make the portion more susceptible to deformation. Likewise, the weakened portion could be constructed, formed, or bent so that the portion is structurally weaker than the rest of the container wall collar. Further, the weakened portion could be located at a particular point on the container wall collar perimeter. The preferred embodiment of the invention utilizes the weakened portion as an annular weakened portion about the closure opening.

FIGS. 5 and 6, a second embodiment of the invention, show such a weakened portion indicated by B wherein the weakened portion deforms and the sealing wedge is maintained. Such a weakened portion could be the result of the material used therein, the geometry of the construction, or the prebending of the container wall collar. Nevertheless, this second embodiment shows an alternate construction that permits deformation of the container wall collar 34 annular to the portion of the container wall collar 34 in wedged engagement with sealing member 24.

Referring now to the preferred embodiment shown in FIGS. 3 and 4, the weakened portion is formed by a notch or prebent portion adjacent the second recess area 44. The weakened portion is preferably created by the formation of an annular notch 54 located on the exterior surface of the container wall collar 34 so that the container wall collar 34 will bend inwardly at the notch 54 in response to an external force. Preferably, the notch is a V-shaped indentation, although other suitably shaped indentations could be utilized either on the interior or exterior surface of the container wall depending upon the deformation desired.

Notch 54 is located on an exterior portion of the second, inwardly sloped, annular wall 42 not in wedged engagement with the sealing member 24. Directly opposite the notch is a gap 56, shown only in FIG. 4, formed between the second, inwardly sloped, annular wall 42, the sealing member 24, and the base 22. This gap permits the second, inwardly sloped, annular wall 42 to deform into a predetermined area that will enhance the wedge applied to sealing member 24. Therefore, the container wall collar 34 can deform in a predetermined fashion that will enhance the wedging of the sealing member rather than that destroy or deteriorate the wedge and still absorb the impact of the external force. To further insure proper deformation, the second, inwardly-sloped, annular wall 42 may include a pivot 58, shown in FIG. 4, located radially outwardly from the notch 54 to engage the closure bushing base 22 during application of an external force so as to force the notch 54 to deform inwardly into gap 56.

Figure 7:
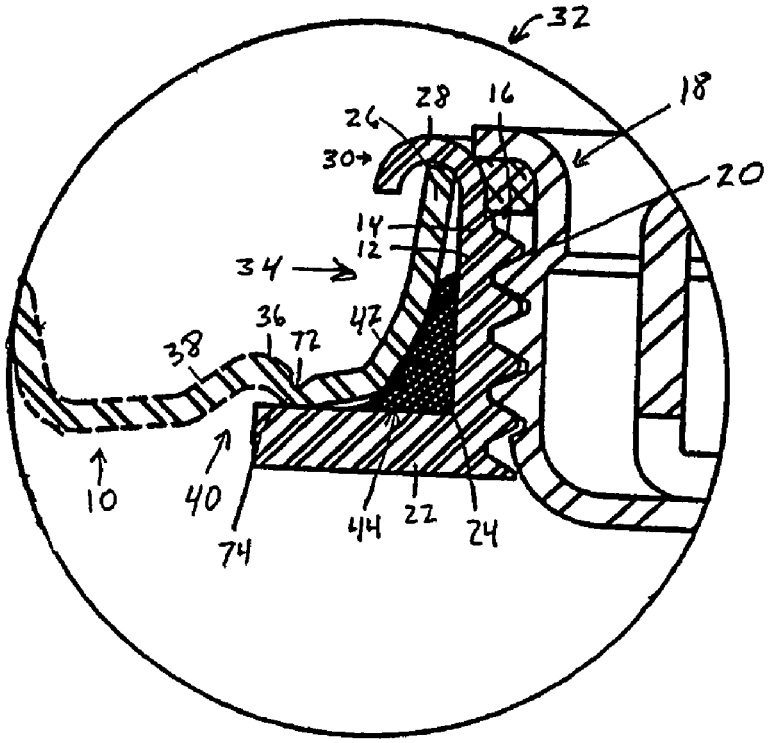
FIG. 7 is a fragmentary, cross-sectional view of a third embodiment of the present invention showing the sealing wedge maintained after the application of an external force.
Figure 8:
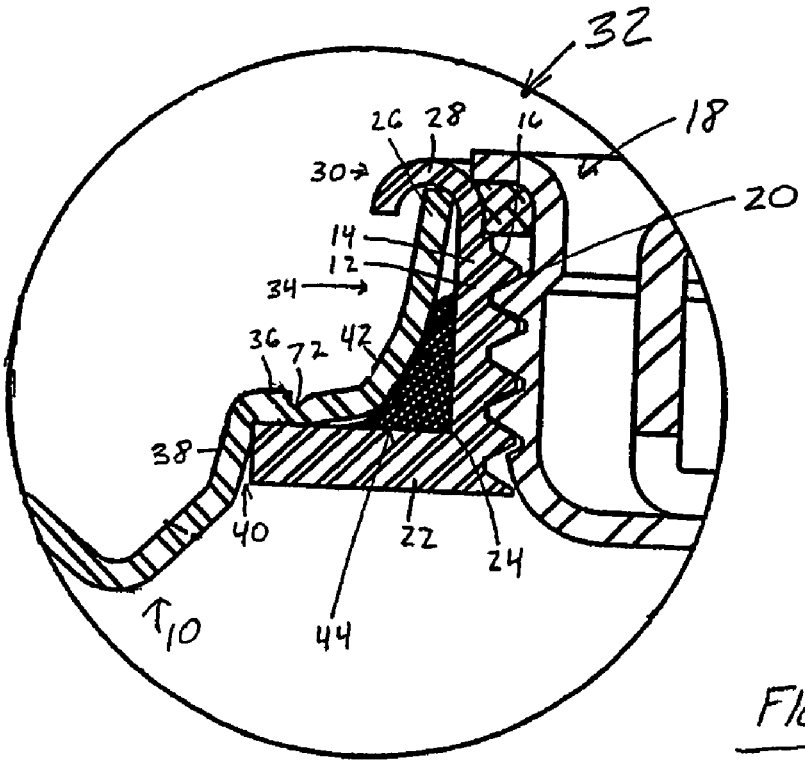
FIG. 8 is a fragmentary, cross-sectional view of the closure of FIG. 7 prior to the application of an external force.

Referring now to a preferred embodiment shown in FIGS. 7 and 8, the container wall 10 includes an upwardly-extending collar 34 integral therewith and defining an opening within the container wall 10. The opening is capable of receiving a closure bushing 12 for providing access to the interior of the container for insertion and removal of materials. The container wall collar 34 comprises a recessed wall 36 connected to the container wall 10 by a first annular wall 38 to define a first recess area 40. It is within this first recessed area 40 that closure bushing base 22 is nested during wedging of the closure bushing. A second, inwardly sloped, annular wall 42 is connected to the recessed wall 38 to define a second recess area 44 capable of retaining and wedging at least one sealing member 24. Finally, flange 26 is connected to the second, inwardly sloped, annular wall 42 to form the container opening. Although the collar 34 in FIGS. 7 and 8 does not show the third, inwardly sloped, annular wall 46, the first upwardly extending flange 48, or the third recess area 50 as shown in FIGS. 4 through 6, it is contemplated by the present inventor that the collar 34 may further include these features.

FIGS. 7 and 8 further show a weakened portion preferably created by the formation of an annular notch 72 located on the exterior surface of the recessed wall 36 of the container wall collar 34. The container wall collar 34 will bend inwardly at the notch 72 in response to an external force. Preferably, the notch is a V-shaped indentation, although other suitably shaped indentations can be utilized either on the interior or exterior surface of the container wall 10 or container wall collar 34 depending upon the deformation desired.

FIG. 8 further shows the deformation of the container wall collar 34 at the notch 72. The bending of the collar 34 at the notch 72 creates a pivot 74 on the internal wall of the collar 34 so as not to deform the portion of the container wall collar 34 or container wall 10 in wedged engagement with the sealing member 24.

Therefore, in operation, as an external force is exerted to the container closure assembly from any direction, the container wall collar 34 and sealingly engaged closure bushing 12 can move relative to the container wall 10 through the deformation of the weakened portion of the container wall collar 34. Such a weakened portion will be the first portion to deform upon the issuance of an external force and therefore absorb the forces that could potentially damage the sealing wedge. Therefore, if a force acts upon the container closure assembly to such an extent so as to cause deformation therein, deformation of the container wall collar occurs at the predetermined weakened area, but not at the expense of the overall seal.

The present invention also comprises a method for preventing leakage from a container closure assembly wherein the method comprises providing a weakened portion in a container wall, substantially as described above, wherein the weakened portion is not in wedged engagement with the sealing member. Therefore, the weakened portion will bend in response to an external force so as not to deform the portion of the container wall in wedged engagement with the sealing member. As described above, the weakened portion preferably is annular to the opening. The weakened portion could comprises a portion of the container wall that is prebent to weaken the portion. Preferably, the weakened portion comprises a notch located on a portion of the second, inwardly sloped, annular wall not in wedged engagement with the sealing member.

The invention has been described with reference to the preferred embodiment. Obviously, modifications and alternations will occur to others upon a reading and understanding of this specification. The claims as follows are intended to include all modifications and alterations insofar as they come within the scope of the claims or the equivalents thereof.

I claim:

1. A container closure assembly comprising:

a container wall defining an interior storage area;

a collar extending upwardly from said container wall and defining an opening to said storage area;

a closure bushing comprising an internally threaded neck held within said collar and a radially outwardly extending base extending from the lowermost end of said internally threaded neck, said base nested within said storage area;

a plug having an exteriorly threaded portion for threaded engagement with said internally threaded neck to provide closure to said closure assembly;

at least one sealing member wedged between said closure bushing and said collar; and a weakened portion for permitting a portion of said collar or said container wall not in wedged engagement with said sealing member to bend in response to an external force.

2. The assembly of claim 1 wherein said collar further comprises a recessed wall connected to said container wall by a first annular wall to define a first recess area.

3. The assembly of claim 2 wherein said weakened portion is located annularly about said opening.

4. The assembly of claim 3 wherein said annular weakened portion comprises a notch.

5. The container closure assembly of claim 4 wherein said notch is located on an exterior surface of said collar of said container wall.

6. The container closure assembly of claim 4 wherein said notch is located on a portion of said recessed wall.

7. The container closure assembly of claim 4 wherein said notch is located on an external portion of said recessed wall.

* * * * *